United States Patent [19]

Croley et al.

[11] Patent Number: 4,572,687

[45] Date of Patent: Feb. 25, 1986

[54] REPETITIVE MODE FOR THERMAL PRINTING LIFT-OFF CORRECTION

[75] Inventors: Donald F. Croley, Georgetown; Stanley Dyer, Lexington, both of Ky.

[73] Assignee: International Business Machines Corporation, Armonk, N.Y.

[21] Appl. No.: 636,434

[22] Filed: Jul. 31, 1984

[51] Int. Cl.[4] ..... B41J 29/373

[52] U.S. Cl. ..... 400/696; 400/120

[58] Field of Search ..... 346/21, 76 PH; 400/120, 400/696–697.1

[56] References Cited

U.S. PATENT DOCUMENTS

| | | | |
|---|---|---|---|
| 4,307,971 | 12/1981 | Kane et al. | 400/697 |
| 4,384,797 | 5/1983 | Anderson et al. | 400/696 |
| 4,396,308 | 8/1983 | Applegate et al. | 400/696 |
| 4,429,318 | 1/1984 | Kobata | 400/697.1 |
| 4,434,356 | 2/1984 | Craig et al. | 400/120 X |
| 4,453,839 | 6/1984 | Findlay et al. | 400/120 |

FOREIGN PATENT DOCUMENTS

| | | | |
|---|---|---|---|
| 2301565 | 11/1973 | Fed. Rep. of Germany | 400/697 |
| 142883 | 8/1983 | Japan | 400/696 |

OTHER PUBLICATIONS

*IBM Technical Disclosure Bulletin,* entitled "Self-Correcting Thermal Ink," by W. D. Bailey et al., vol. 25, No. 11A, Apr. 1983, p. 5811.

*Primary Examiner*—Paul T. Sewell

*Attorney, Agent, or Firm*—John A. Brady

[57] ABSTRACT

Ribbon (22) in thermal printing has an outer layer which adheres to printed characters of intermediate temperatures, lower than printing temperatures. The printhead (7) has a column of electrodes (9) which sweep across the character area. Erase mode selector (16) causes erase of the same character twice, first at a temperature level moderately more than the normal erase level and one at a temperature moderately less than the normal erase level. Erasure in that dual mode is generally effective even for extreme conditions of paper, environment and other influences.

8 Claims, 3 Drawing Figures

REPETITIVE MODE FOR THERMAL PRINTING LIFT-OFF CORRECTION

DESCRIPTION OF THE INVENTION

1. Technical Field

This invention relates to lift-off correction of thermal printing.

This is a refinement to the field of thermal lift-off correction described and claimed generically in U.S. Pat. No. 4,384,797 to Anderson et al, which is assigned to the same assignee to which this application is assigned. In such correction, the outer layer of a ribbon adheres to printing at temperatures intermediate between room temperatures and printing temperatures. After some cooling, a bond exists between printing and the ribbon so that the printing may be lifted away as the ribbon is moved from contact with the printing.

In actual use, paper printed upon and printing conditions may vary widely. Although the correction may be entirely satisfactory for most printing operations, specific characteristics of the paper, of ambient conditions, of printer functioning, or combination of such factors may result in unsatisfactory results. This invention includes a mode of operation to avoid loss of satisfactory correction.

2. Background Art

The foregoing U.S. Pat. No. 4,384,797 to Anderson et al describes and claims generically this lift-off correction at intermediate temperatures. U.S. Pat. No. 4,396,308 to Applegate et al, also assigned to the same assignee to which this application is assigned, describes and claims generically a guide on a pivoted arm which is moved at lift-off correction to a position which holds the ribbon to the printing past the print position to allow a bond to set.

This invention involves a mode employing dual lift-off correction drive levels, which mode may be operator-selectable over the mode with a single correction level. U.S. Pat. No. 4,429,318 to Kobuta shows the erasure of thermal printing by dual covering. Since this does not involve lift-off correction, it necessarily does not teach the dual drive levels of this invention. U.S. Pat. No. 4,307,971 to Kane et al and West German No. 2,301,565, patented Nov. 29, 1973, teach dual impacts on an erase ribbon, but not at different impact levels. (With respect to the German patent, this characterization is based only on a brief English summary attached to the available copy.)

DISCLOSURE OF THE INVENTION

In a thermal printer having an erase capability of erasing using intermediate heat, the additional capability is provided to erase the same character twice at two significantly different drive levels to the heat-producing drive elements. Both drive levels produce temperatures which are near the normnally effective or nominal level and are therefore in the range of probable effective lift-off correction. Normally, the first of these two erase temperatures is the higher, since, if undesired printing results, that will be erased by the second, lower level printing. In the preferred implementation, the first drive level is moderately more than the single-erase mode drive level and the second drive level is moderately less than the single-erase mode drive level.

In most applications, a single erasure is adequate. Typically, single erasure may be unsatisfactory only when the printing is on certain types of paper. Less frequently, factors such as environmental heat and humidity and variations in the ribbon or the printer elements, may also render single erasure unsatisfactory. Preferably, the dual mode is made operator-selectable so that it is not employed when that is unnecessary.

The most difficult papers for erasure are those which are exceptionally rough and absorptive. Where this dual mode is employed, a very wide range of papers used for letters and other documents may be printed upon and lift-off erased from with excellent results.

BRIEF DESCRIPTION OF THE DRAWING

This lift-off correction development is illustrated by the drawing in which.

BEST MODE FOR CARRYING OUT THE INVENTION

Figure 1:
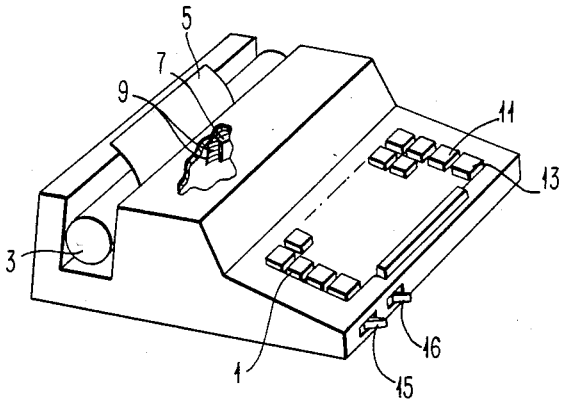
FIG. 1 is illustrative of a typewriter system in representative form.

As shown illustratively in FIG. 1, the printer is a typewriter having the usual keyboard 1, a platen 3 upon which paper 5 to be printed upon is supported and a thermal printing element or printhead 7 with small electrodes 9 to effect printing of a selected character image and to conduct lift-off correction.

One of the keybuttons 11 effects ordinary backspacing while another keybutton 13 effects erasure operation. Sequencing and other control of typewriter operations and internal functions in response to operation of keyboard 1 is under control of electronic logic and digital processing systems as is now conventional in general respects in electronic typewriters. Preferably, virtually all control is provided by one or more microprocessors which are an internal, permanent part of the typewriter of FIG. 1.

The machine has a control 15 by which an operator may set the level of power to the electrodes 9 within a predetermined range. Where, for example, printing appears lighter than desired, control 15 is adjusted. The effect is to increase power to electrodes 5. In the preferred, specific implementation, control 15 has five settings which vary the current to each electrode 9 within a range up to 25% of the lowest current. (Typical values are a range of 24 milliamperes (ma) to 28 ma, with each of the five settings being separated from the nearest setting by 1 ma.) Control 15 automatically varies the power for erase directly with the print power, the normal single-step erase level being in this specific description 3 ma less than the print level. The machine has a second control 16, having two positions, by which an operator selects the single mode erase or the dual mode erase.

Figure 2:
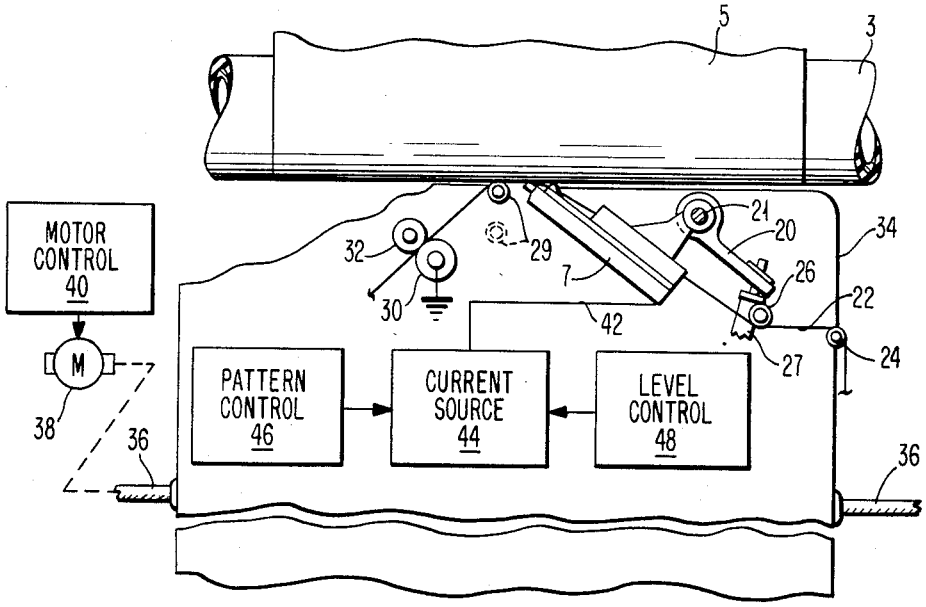
FIG. 2 is a top view of such a system.

In FIG. 1, the printhead 7 is shown broken away on the side toward keyboard 1. The remaining structure is schematically indicated in FIG. 2. Toward the platen 3, the supporting structure of printhead 7 is shown broken away to emphasize the single vertical row of electrodes 9 which are mounted within the printhead 7. During normal operation, each electrode 9 may be connected to a high energy source or not so connected, depending on the image selected to be printed by heat produced by the printhead 7.

FIG. 2 is a top view, also generally illustrative only, of the area at which printing and erase are conducted.

Positioning member 20, pivoted at point 21, is attached to printhead 7. Ribbon 22 is directed around tensioning roller 24, across a guide roller 26, and to the end of printhead 7. Link 27 engages an arm of member 20, and, when moved away from platen 3 (the position shown in FIG. 2), link 27 pulls member 20 clockwise to force the end of printhead 7 against paper 5 mounted on platen 3. Link 27 is moved the opposite direction to move printhead 7 away from paper 5.

When link 27 is in the outward position shown in FIG. 2, ribbon 22 is pressed between the end of printhead 7 and paper 5. Ribbon 22 is then in contact with the ends of the vertical column of electrodes 9 (FIG. 1), which are mounted in printhead 7. A guide member 29 is selectably movable toward and away from platen 3. During correction, guide member 29 is moved toward platen 3 to present a face at paper 5 a preselected distance prior to the printing position. Ribbon 22 is thereby positioned flat with paper 5 at the printing point and for the preselected distance prior to the printing point. In a typical printing operation, the preselected distance is the width of at least two characters.

Metering of the ribbon 22 is effected by cooperating rollers 30 and 32 located on the take-up side of printhead 7. Roller 30 may also constitute a connection to ground. The printhead 7, arm 20, guide rollers 24 and 26 and metering rollers 30 and 32 are mounted on a carrier 34 which moves across the length of a stationary platen 3 under forces provided by belt or cable 36, driven by a controllable electrical motor 38. Motor 38 may be a conventional direct current motor. A drive control system 40 to motor 38 defines the speed and direction of motor 38. The drive control 40 may be conventional in providing currents to motor 38 of a magnitude and polarity to achieve output movements having torque and direction as required, all under control of a general purpose microprocessor.

An electrical lead, shown illustratively as a single wire 42, connects to electrical power source 44. Power source 44 may be any system or circuitry suited to selectively drive the desired patterns of electrodes 9 with the predetermined power level. A specific circuit particularly suitable as source 44 is described in U.S. Pat. No. 4,434,356 to Craig et al. Two aspects of that circuitry of particular interest with respect to this invention are that the level of input drive may be selected by setting a single reference level potential, denominated Vlev, and the drive to each electrode 9 is selected or not selected under control of a single input potential, denominated Vsel. Where the Vsel signal is at the non-select level, the drive circuit to the associated electrode is simply inactivated or "switched off."

Also included in FIG. 2 is the pattern control system 46. The preferred implementation including control 46 for this invention is that as described in U.S. patent application Ser. No. 540,967, filed Oct. 11,1983, to J. C. Bartlett et al, and assigned to the same assignee to which this invention is assigned. As described in detail there, erasure is by pulses, the net effect of which is the intermediate heat for correction. The pattern control 46 provides a predetermined configuration for correction of "off" and "on" signals for each electrodes 9 continuously and alternately with pulses generally of equal zero and high duration, with the current to erase being generally the same as the print current. The overall erase pattern corresponds to a checkerboard of drive and not drive, but with electrodes at positions corresponding to underlines receiving longer high drive than zero drive pulses. This block erase by pulses provides improved functioning, which appears to result from interface effects and the like of the ribbon being closely similar because the printing level and significant erase level are closely similar.

In this specific embodiment, the erase level is moderately different from the printing level (specifically 3 ma below the printing level) because the final current levels are more readily determined with respect to varying current, as small variations in the cycle times are not readily implemented. Level control system 48, shown illustratively in FIG. 2, responds to operator control 15 to set the print and single erase levels described. Level control 48 further responds to operator control 16 to set the dual erase levels as will be described. Typical implementation is by a microprocessor generating predetermined binary patterns in response to the settings of controls 15 and 16 as inputs. That binary pattern typically is an input to a digital-to-analogue converter, a well known type of circuit, to produce a control voltage related directly to the predetermined pattern. Where a specific application requires predetermined current levels for control, the binary pattern or the analogue voltage may be readily converted by standard circuits to a fixed current of corresponding level.

The ribbon 22 is a laminated element having an outer layer of thermoplastic, pigmented marking material which may be in the order of magnitude of 5 microns in thickness, an aluminum intermediate layer which may be 1000 angstroms in thickness, which serves as current return path, and a resistive substrate which may be in the order of magnitude of 16 microns in thickness. The ribbon 22 is, of course, wide enough to fit across the entire vertical row of electrodes 9.

Printing typically is by complete release, and ribbon 22 must be incremented with each printing step. Printing is effected by energizing selected ones of the electrodes 9 while those electrodes 9 are in contact with the substrate of ribbon 22. The substrate of ribbon 22 is also in contact with a broad, conductive area, such as roller 30 connected to ground, which disperses current beyond the location of electrodes 9. The high current densities in the areas near the energized point electrodes 9 produce intense local heating which causes, during printing, melting of marking material and resulting flow onto the paper 5. During printing, guide member 29 is away from platen 3 so that the ribbon 22 is pulled away from paper 5 while still hot. During lift-off correction, guide member 29 is moved to paper 5 so that ribbon 22 is held against paper 5 in the span between printhead 7 and guide member 29. During lift-off correction, the electrical energy is reduced, to thereby cause a heating which brings out adhesion of the outer marking layer without flow from ribbon 22.

Figure 3:
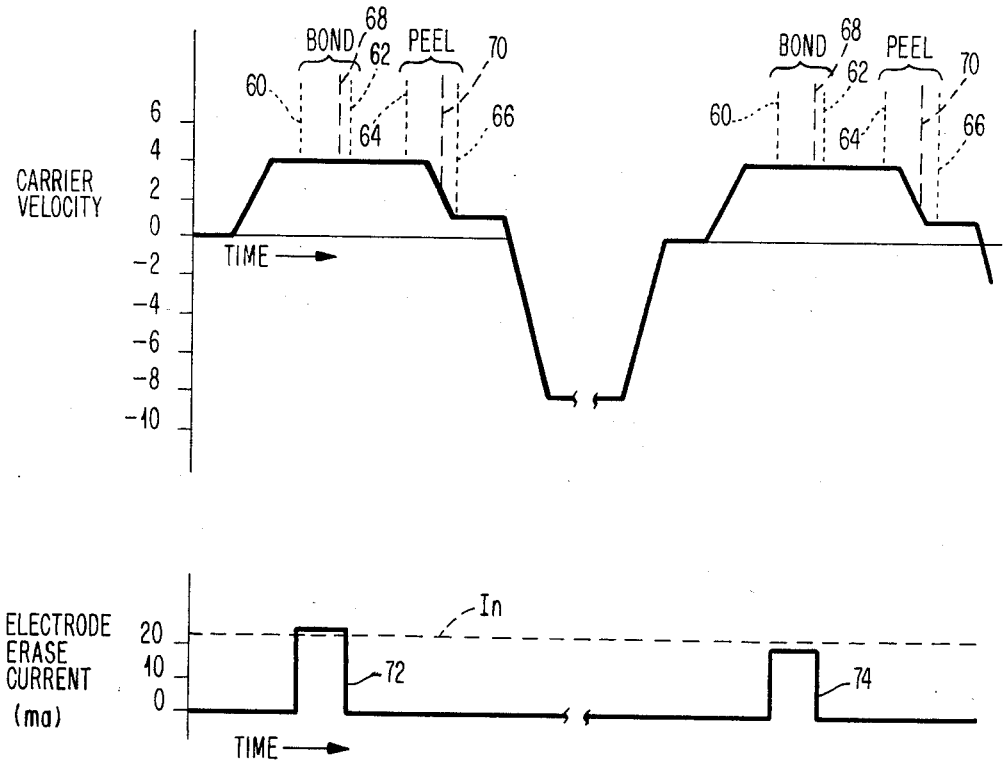
FIG. 3 is a graph of carrier velocity and erase current levels which is demonstrative of the dual mode operation.

The foregoing application Ser. No. 540,967 describes more specifically the pattern drive with block erase which is preferred as specific drive of electrodes 9 during release. The basic lift-off correction system upon which this invention is an improvement or modification is described in the foregoing U.S. Pat. No. 4,384,797. Alternative ribbons are described in U.S. Pat. No. 4,453,839 to Findlay et al and in IBM Technical Disclosure Bulletin article entitled "Self-Correcting Thermal Ink," by Bailey et al, Vol. 25, No. 11A, April 1983, at p. 5811. FIG. 3 illustrates the movement and current levels which embody this invention.

FIG. 3 shows the velocity of carrier 34, which carries printhead 7, with respect to time over a period in which the double erase mode of this invention occurs. The time scale is linear, except where shown broken during the relatively long return time to commence the second erase operation. The lower diagram shows erase current plotted on the same time scale. Points of bonding and peeling for a 10 pitch character, one character per 0.1 inch (about 0.254 cm) are shown at the times they occur on the velocity-time diagram by dotted lines. Carrier 34 is moved at 4 inches per second (about 10.16 cm per second) from prior to bonding to past the start of peeling. The start of bonding is shown by a dotted line 60 and the end of bonding by dotted line 62. Similarly, the start of peeling is shown by dotted line 64 and the end of peeling by dotted line 66. Bonding for correction, of course, occurs during the current pulses to electrodes and is, accordingly, indicated during the same time periods on the current-time diagram. Peeling begins 0.03 inches (about 0.0762 cm) prior to the start of decrease of velocity to the next lower level, which is 1.5 inches (about 0.381 cm) per second. For a 10 pitch character, it ends shortly after the velocity levels to 1.5 inches per second.

A second standard character size is 12 pitch, one character per 1/12 inch (about 0.212 cm). The start of the bond and peel point for 12 pitch may be considered the same for purposes of illustration in FIG. 3, but the character ends at a distance about 0.83 that of the 10 pitch character. Thus, the start of bonding for 12 pitch is also shown by dotted line 60, but the end of bonding for 12 pitch is shown by line 68 of longer dashes. Similarly, the start of peeling for 12 pitch is shown by dotted line 64, but the end of peeling for 12 pitch is shown by line 70 of longer dashes.

Peeling occurs when ribbon 22 carrying printing to be lifted-off passes guide member 29 and thereby separates from paper 5. Since guide 29 is located a fixed distance past printhead 7, the time between the start of bonding and the start of peeling is necessarily a direct function of carrier 34 velocity. Carrier velocity could be decreased after the start of peeling for 12 pitch characters so that the end of peeling occurs after the velocity reaches 1.5 inch per second, as occurs for 10 pitch. No advantage has been observed for that. On the other hand, although the mechanism is not understood, the start of peeling prior to the deceleration toward 1.5 inch per second does seem to contribute to full, high quality erasure. By not changing the carrier velocity pattern whether the font is 10 pitch, 12 pitch, or other set size, or a basic standard proportional-spacing font of variable-width character, the start of peeling prior to the deceleration is achieved for each such font.

The diagrams start with carrier 34 at the left, ready for an erase operation. Accordingly, velocity in the plus sense represents movement from left to right of the typewriter (to the right in FIG. 2). The negative velocity represents a high-speed return to reposition carrier 34 for a second erase operation of the same print region. The return print velocity is 10 inches (about 25.4 cm) per second.

Shown as a pulse 72 is the current to effect the first of two erase modes. The magnitude of erase currents shown in FIG. 3 are those for print level of 26 ma. The magnitude of pulse 72 is 1 ma more than the nominal or normal one step erase level, In. A typical value of In is 3 ma less than the print level. Pulse 72 is In plus 1 ma. Where the print level is 26 ma, the nominal erase level is 23 ma and the level of pulse 72 is 24 ma. Current for the second erase operation in the dual mode erase is shown on a pulse 74. The magnitude is In minus 2 ma, or 21 ma when the print level is 26 ma. These levels are close to or approximate the usually effective level, and therefore one of them should provide temperatures near the ideal level for the specific erase operation.

As indicated in the foregoing, the erase currents are applied as a pattern as described in application Ser. No. 540,967. The pulses shown in FIG. 3 are therefore demonstrative of the time when the rapidly alternating pattern of drive pulses is applied to electrodes 9 and of the level applied during the "on" intervals. Although this invention has been primarily developed with respect to an embodiment having the pattern drive for erase, nothing appears suggesting that a constant erase current at a lower level than the drive current, as specifically described in the foregoing U.S. Pat. No. 4,384,797, would not be entirely operable with this invention.

In some environments, the In+1 input is clearly ineffective in that a regular rectangle is printed. Nevertheless, the second operation, at In−2, will normally erase that printing and the dual mode operation will be effective.

As the dual mode consumes extra time for each erasure, it is not routinely employed. Where erasure is unsatisfactory, the operator selects the dual mode with switch 16. The unsatisfactory erasure typically is from either a tendency to print rather than erase or a failure to bond because of low temperature at erase. The operator need have no understanding of this. Where normal erasure is unsatisfactory, the operator can in any case expect improvement by switching to the dual mode. The dual mode is effected by motor control 40 and pattern control 46 applying double erase as described.

As this conducts erasure at moderately higher and lower levels from the levels normally effective for erasure, satisfactory erasure does occur in almost all circumstances in which the conditions are at all similar to even extreme printing materials and environments. Moreover, where the first erasure is only partially effective because of a strong bond of the printed character, the second erase will operate on a largely-removed character and normally is effective to complete the erasure.

It will be apparent that modifications from the specifics shown can be made without departing from the essential contribution of this invention. Accordingly, coverage should not be limited by such specifics, but should be according to law, with particular reference to the accompanying claims.

What is claimed is:

1. A thermal printer having a power source to power heat-producing elements which can be selectably activated for lift-off correction while in contact with an erase medium normally operative within a range of levels of activation of said elements comprising means to cause said printer to erase a single area of printing by traversing said area once while activating said elements for lift-off correction at a first level of activation within said range and then once while activating said elements for lift-off correction at a second level of activation within said range, said second level lower from said first level by at least five percent of said first level.

2. The printer as in claim 1 in which both said first level and said second level are different from one level within said range used for lift-off correction in a single traverse.

3. The printer as in claim 2 in which said first level is more than said one level and said second level is less than said one level.

4. The printer as in claim 1 also comprising operator-selectable means to select a first mode of operation in which erasure is by a single traverse of said area while activating said elements for lift-off correction at one level within said range and to select a second mode of operation in which erasure is by automatically traversing said area while activating said elements for lift-off correction at said first level and then at said second level.

5. The printer as in claim 2 also comprising operator-selectable means to select a first mode of operation in which erasure is by a single traverse of said area while activating said elements for lift-off correction at said one level and to select a second mode of operation in which erasure is by automatically traversing said area while activating said elements for lift-off correction at said first level and then at said second level.

6. The printer as in claim 3 also comprising operator-selectable means to select a first mode of operation in which erasure is by a single traverse of said area while activating said elements for lift-off correction at one level within said range and to select a second mode of operation in which erasure is by automatically traversing said area while activating said elements for lift-off correction at said first level and then at said second level.

7. The printer as in claim 3 also comprising operator-selectable means to select a first mode of operation in which erasure is by a single traverse of said area while activating said elements for lift-off correction at said one level and to select a second mode of operation in which erasure is by automatically traversing said area while activating said elements for lift-off correction at said first level and then at said second level.

8. The process of correcting an image printed in a thermoplastic marking material employing an erase medium having an outer layer which forms a bond for lift-off correction of thermal printing made by said marking material at temperatures varying between the highest and lowest temperatures of a temperature range, comprising the steps of:

(1) positioning said erase medium over a character printed in said marking material.

(2) raising the temperature of said erase medium to a first temperature in said temperature range, then (3) moving said outer layer away from the location at which said character is printed to lift said character away when said first temperature is effective to form said bond, then (4) positioning said erase medium over the same location of said character, (5) raising the temperature of said erase medium to a second temperature in said temperature range lower than said first temperature by an amount sufficient to form said bond to effect erasure when said first temperature effects printing, and then (6) moving said outer layer away from said location to lift said character away when said second temperature is effective to form said bond.

* * * * *